US005184795A

United States Patent [19]

Sexton

[11] Patent Number: 5,184,795

[45] Date of Patent: Feb. 9, 1993

[54] MANICURE STAND

[76] Inventor: P. Wayne Sexton, 306 Rockvale Dr., Piedmont, S.C. 29673

[21] Appl. No.: 765,882

[22] Filed: Sep. 26, 1991

[51] Int. Cl.[5] ..... B68G 5/00

[52] U.S. Cl. ..... 248/118; 132/73

[58] Field of Search ..... 248/118, 118.1, 118.3, 248/118.5; 132/73

[56] References Cited

U.S. PATENT DOCUMENTS

| | | | |
|---|---|---|---|
| 915,047 | 3/1909 | Smith | 248/118 |
| 2,172,178 | 9/1939 | Rosenberg | 248/118 |
| 2,561,001 | 7/1951 | Ward | 248/118 X |
| 4,332,263 | 6/1982 | Kitrell | 248/118 X |
| 4,390,011 | 6/1983 | Evans | 248/118.3 X |
| 4,650,141 | 3/1987 | Longo et al. | 248/118 |
| 4,915,331 | 4/1990 | Becker et al. | 248/118 |

*Primary Examiner*—Ramon O. Ramirez
*Attorney, Agent, or Firm*—Bailey & Hardaway

[57] ABSTRACT

An arm support and finger positioning stand for use by a manicurist in manicuring the fingernails of a customer has a first transverse arcuate surface B positioned at a level for supporting the hand by engaging the arm just below the wrist to serve as an arm rest; and a second transverse arcuate surface D positioned above and forwardly of the first transverse arcuate surface at a level for receiving the palm of the customer's hand with the fingers extending forwardly and curved downwardly resting upon a forward portion of the second transverse arcuate surface in position for being individually raised for manicuring a respective fingernail with the remaining fingers resting upon the forward position of the second transverse arcuate surface.

2 Claims, 1 Drawing Sheet

Fig. 1.
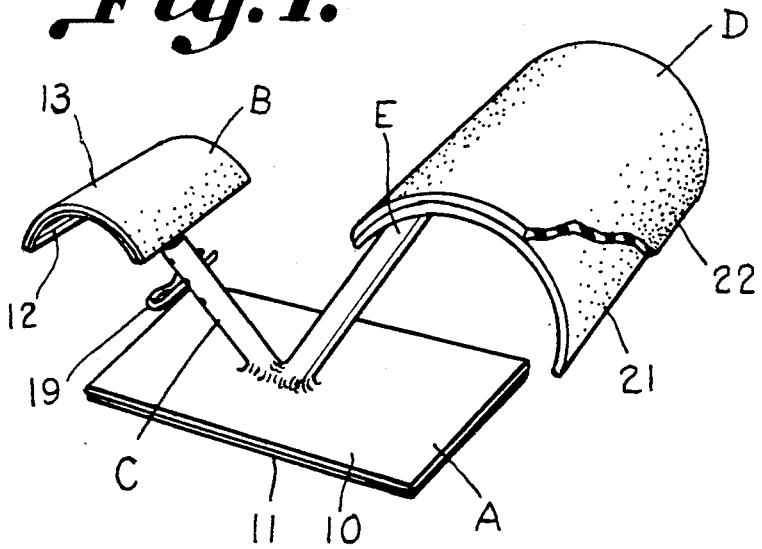
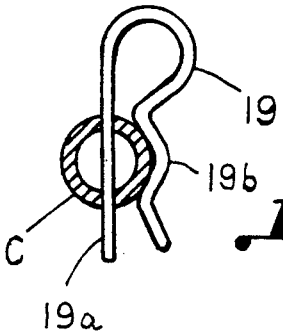
Fig. 3.
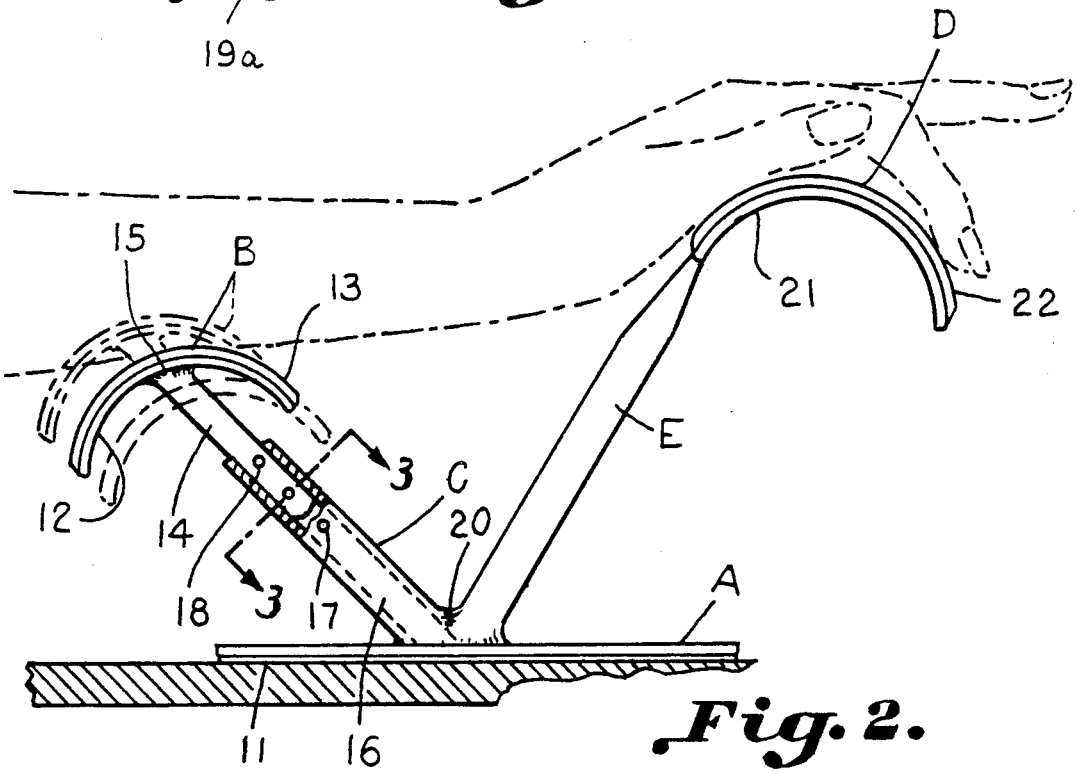
Fig. 2.

MANICURE STAND

BACKGROUND OF THE INVENTION

This invention relates to an arm supporting and finger positioning stand for use by a manicurist which comfortably positions a customer's hand for protracted periods of time as required for a manicure while making the individual's fingernails readily accessible to the manicurist.

The present practice in manicuring the fingernails of a customer at a beauty parlor and the like is to use whatever is at hand, usually simply a table top in conjunction with a bowl containing liquid for treating the nails. Efforts have been made to provide apparatus for supporting the arm and fingers of a customer which utilizes spaced supports, one located adjacent the wrist while another carries the fingers pointed toward the beauty operator or manicurist. U.S. Pat. No. 4,915,331 illustrates the use of a transverse arcuate bar for supporting the arm adjacent the wrist and a fixture for supporting the hand upon a vertical pedestal which has indentations positioning the fingers in spread horizontal relationship. Such a device is relatively complicated and expensive for performing a simple task and its disadvantages appear to offset the conveniences achieved through its use.

Other U.S. Pat. Nos. which illustrate the state-of-the-art include the following: 915,047; 2,169,990; 2,392,626; and 2,561,001.

Accordingly, it is an object of this invention to provide an effective manicure stand for supporting the arm and fingers of a customer comfortably and conveniently accessible by the operator, and which is of simple inexpensive construction.

Another important object of the invention is to provide a manicure stand which is portable and which is capable of accommodating various sizes and shapes of customers.

Another important object of the invention is the provision of a manicure stand which has first and second arcuate surfaces, the second of which is spaced forwardly of and above the first and positions the hand comfortably with fingers curved downwardly for being raised individually for access by the operator during treatment of respective nails.

SUMMARY OF THE INVENTION

A manicure stand for supporting the arm and positioning the fingers of a customer having a manicure has a portable flat base member which is positionable upon a table for supporting a first transverse arcuate surface which is substantially horizontal, and a second transverse arcuate horizontal surface positioned above and forward of the first surface for supporting the hand of the customer so that the fingers are curved downwardly to place the fingers in a comfortable position with the nails readily accessible to the operator for manicuring the nails of respective individual fingers.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 1 is a perspective view illustrating a manicure stand constructed in accordance with the invention supporting the arm and hand of a customer, as shown in broken lines, for aiding in the giving and receiving of a manicure;

FIG. 2 is an enlarged side elevation illustrating the components illustrated in FIG. 2 with the hand and arm of the customer illustrated in broken lines; and FIG. 3 is a sectional elevation taken along the line 3—3 in FIG. 2.

DESCRIPTION OF A PREFERRED EMBODIMENT

An arm support and finger positioning stand for use by a manicurist in manicuring the fingernails of a customer includes a flat base member A movably positionable upon a table for carrying the arm and hand of a customer with fingers in forwardly extended position toward the manicurist. A first transverse arcuate surface B is positioned above and carried by the flat base member at a level for supporting the hand by engaging the arm just below the wrist to serve as an arm rest. A first centrally disposed positioning link C is fixedly secured to the first transverse arcuate surface on one end and to the flat base member on the other end. A second transverse arcuate surface D is positioned above and forwardly of the first transverse arcuate surface carried by the flat base member at a level for receiving the palm of the customer's hand with the fingers extending forwardly and curved downwardly generally following a forward portion of the second transverse arcuate surface in position for being individually raised for manicuring a respective fingernail with the remaining fingers resting upon the forward portion of the second transverse arcuate surface. A second centrally disposed positioning link E is fixedly secured to the second transverse arcuate surface on one end and to the flat base member on the other end. Thus, the fingernails are readily accessible to the manicurist while the hand is comfortably positioned for the extended period required for a manicure.

FIG. 1 illustrates a manicure stand constructed in accordance with the invention wherein a portable flat base member A includes a substantially rectangular plate 10 which carries a pad member 11 constructed of hard rubbery material having a high coefficient of friction so as to avoid sliding when the manicure stand is positioned upon a table to receive the hand of a customer for aiding in a manicure.

A first transverse arcuate surface B is illustrated as including an arcuate base support member 12 carrying a suitable covering material 13 which may be of a deformable material for cushioning the arm just below the wrist of a customer. The horizontal transverse arcuate first support member B is carried by a downwardly and inwardly extending link or positioning member C. The member C comprises a telescopically mounted central positioning portion 14 which is secured a by welding at 15 to the under side of the curved metallic member 12. The telescopically mounted portion 14 is carried within a sleeve 16 which has a bore therein for receiving the member 14 and the apparatus is fixed by providing holes 17 in the sleeve for coming into alignment with opening 18 in the member 14 for reception of a cotter pin 19 and the like. The cotter pin 19 has a straight shank **19*a* and a curved portion 19*b* opposite thereto for coming into gripping arrangement with the link member C for avoiding dislodgement and turning of the member 14 within the sleeve 16**.

A forwardly and upwardly extending link E is welded as at 20 to or closely adjacent an end of the link C for fixed attachment to the base member A. The links C and E are positioned centrally with respect to arcuate members B and D. The arcuate member D has fixed connection with a free end of the link E and comprises a metallic curved portion 21 for carrying a suitable coating or covering 22. It will be observed by reference to FIG. 2 that the arm is supported below in broken line position. The fingers curve generally downward following the arcuate curvature of the surface D for access and comfort in positioning the fingers of the customer so that they may be readily raised for attention by the manicurist as further illustrated in FIG. 2.

It is thus seen that I have provided a vertical tool for facilitating manicuring and which may be adjustable for accommodating the hands of the customer of a variety of sizes and shapes.

While a preferred embodiment of the invention has been described using specific terms, such description is for illustrative purposes only, and it is to be understood that changes and variations may be made without departing from the spirit or scope of the following claims.

What is claimed is:

1. An arm support and finger positioning stand for use by a manicurist in manicuring the fingernails of a customer comprising:

a flat base member movably positionable upon a table for carrying the arm and hand of a customer with fingers in forwardly extended position toward the manicurist;

a first transverse arch positioned above and carried by said flat basemember at a level for supporting the hand by engaging the arm just below the wrist to serve as an arm rest;

a first centrally disposed positioning link fixedly secured to said first transverse arch on one end and to said flat base member on the other end;

a second transverse arch positioned above and forwardly of said first transverse arcuate surface carried by said flat base member at a level for receiving the palm of the customer's hand with the fingers extending forwardly and curved downwardly generally following a forward portion of said second transverse arch in position for being individually raised for manicuring a respective fingernail with the remaining fingers resting upon said forward portion of said second transverse arch; and a second centrally disposed positioning link fixedly secured to said second transverse arch on one end and to said flat base member on the other end;

whereby the fingernails are readily accessible to the manicurist while the hand is comfortably positioned for an extended period of time for the manicure.

2. The structure set forth in claim 1 wherein said first and second positioning links extend downwardly converging inwardly for fixed attachment to said flat base member on said other ends closely adjacent one another, and an adjustment means intermediate said ends of said first positioning link for raising and lowering said first transverse arch for accommodating different customers.

* * * * *